US010653254B2

(12) United States Patent
Alletto, Jr.

(10) Patent No.: US 10,653,254 B2
(45) **Date of Patent: *May 19, 2020**

(54) ZONED SHEETS

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,971

(22) Filed: Feb. 27, 2019

(65) Prior Publication Data

US 2019/0191897 A1 Jun. 27, 2019

Related U.S. Application Data

(63) Continuation of application No. 15/287,132, filed on Oct. 6, 2016, now Pat. No. 10,244,876.

(60) Provisional application No. 62/238,993, filed on Oct. 8, 2015.

(51) Int. Cl.

| | |
|---|---|
| ***A47G 9/02*** | (2006.01) |
| ***A47C 21/04*** | (2006.01) |
| ***A47C 21/06*** | (2006.01) |
| ***A47C 31/10*** | (2006.01) |
| ***D04B 1/10*** | (2006.01) |

(52) U.S. Cl.

CPC ..... *A47G 9/0246* (2013.01); *A47C 21/046* (2013.01); *A47C 21/06* (2013.01); *A47C 31/105* (2013.01); *D04B 1/102* (2013.01); *D10B 2401/10* (2013.01); *D10B 2503/06* (2013.01)

(58) Field of Classification Search

CPC ... A47G 9/0246; A47G 9/0238; A47G 9/0207

See application file for complete search history.

(56) References Cited

U.S. PATENT DOCUMENTS 1,045,228 A * 11/1912 Weltmer ..... A47C 31/105 5/498
3,799,161 A 3/1974 Collins
4,837,879 A * 6/1989 Parnham ..... A47C 20/027 5/648

(Continued)

FOREIGN PATENT DOCUMENTS

FR 2694177 A1 2/1994

OTHER PUBLICATIONS

International Search Report, Written Opinion of the International Searching Authority, PCT/US2016/055702, dated Dec. 21, 2016.

*Primary Examiner* — Eric J Kurilla
(74) *Attorney, Agent, or Firm* — Sorell, Lenna & Schmidt, LLP

(57) ABSTRACT

A zoned bed sheet is provided that includes opposite first and second vertical sidewalls. The sheet includes opposite third and fourth vertical sidewalls that each extend between the first and second vertical sidewalls. A horizontal wall extends between the first and second vertical sidewalls and between the third and fourth vertical sidewalls. The horizontal wall includes a plurality of zones. The zones are spaced apart from one another by a first material. The zones each include a material that is different than the first material.

19 Claims, 3 Drawing Sheets

(56) References Cited

U.S. PATENT DOCUMENTS 5,029,939 A * 7/1991 Smith ..... A61G 7/05776 297/284.1
5,127,119 A * 7/1992 Rogers ..... A47C 27/144 5/730
5,146,634 A * 9/1992 Hunt ..... A47G 9/0207 5/486
5,475,881 A * 12/1995 Higgins ..... A47C 27/146 5/499
6,192,538 B1 * 2/2001 Fogel ..... A47C 27/001 5/685
6,199,231 B1 * 3/2001 Zafiroglu ..... A47G 9/0246 5/497
6,990,701 B1 * 1/2006 Litvak ..... A47C 21/046 5/702
8,307,482 B2 * 11/2012 Gladney ..... A47C 27/148 5/727
10,244,876 B2 * 4/2019 Alletto, Jr. ..... A47C 21/046
2004/0231055 A1 * 11/2004 Sanders ..... A47G 9/0207 5/502
2005/0115282 A1 * 6/2005 Starbuck ..... D04B 1/24 66/176
2006/0130235 A1 6/2006 Wilson
2009/0126107 A1 * 5/2009 Kuo ..... A47C 27/144 5/400
2010/0017962 A1 * 1/2010 Bevan ..... A47G 9/0238 5/482
2010/0024127 A1 * 2/2010 Schantz ..... A47C 27/122 5/500
2011/0000020 A1 * 1/2011 Walvius ..... A47G 9/0246 5/495
2012/0244312 A1 * 9/2012 Pearce ..... D06N 3/106 428/136
2012/0260424 A1 * 10/2012 Agarwall ..... A47G 9/0246 5/497
2015/0265077 A1 * 9/2015 Miller ..... A47G 9/10 5/645

* cited by examiner

ZONED SHEETS

CROSS-REFERENCE TO RELATED APPLICATIONS

This application is a continuation application of U.S. patent application Ser. No. 15/287,132, filed on Oct. 6, 2016, which claims priority to U.S. Patent Application Ser. No. 62/238,993, filed on Oct. 8, 2015. These applications are expressly incorporated by reference herein, in their entireties.

TECHNICAL FIELD

The present disclosure generally relates to bedding, and more particularly to sheets that include a plurality of zones such that certain portions of the sheets have different characteristics than other portions of the sheets.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Many sleepers experience certain portions of their body feeling warmer or cooler than other portions of their body as they sleep. For example, some sleepers may feel that their feet feel colder than their head or middle section when they sleep. Sheets, such as, for example, fitted sheets, are presewn to fit snugly over a mattress in a manner that allows the sheet to remain on the mattress as one or more sleepers lay upon the sheet. Such sheets are typically made out of one material. As such, all portions of the sheet have the same characteristics, such as, for example, breathability and/or porosity. Indeed, conventional sheets fail to take into account that a sleeper may desire certain portions of the sheet to have different characteristics than other portions of the sheet to accommodate a sleeper that experiences certain portions of their body feeling warmer or cooler than other portions of their body as they sleep. This disclosure describes an improvement over these prior art technologies.

SUMMARY

In one embodiment, in accordance with the principles of the present disclosure, a zoned bed sheet is provided. The zoned bed sheet includes opposite first and second vertical sidewalls. The zoned sheet includes opposite third and fourth vertical sidewalls that each extend between the first and second vertical sidewalls. A horizontal wall extends between the first and second vertical sidewalls and between the third and fourth vertical sidewalls. In one embodiment, the vertical sidewall is made from a continuous piece of material connecting the horizontal wall and is configured to fit about a mattress. In another embodiment, the continuous sidewall has at least one zone of different material dispersed within the continuous sidewall. The horizontal wall includes a plurality of zones. The zones are spaced apart from one another by a first material. The zones each include a material that is different than the first material.

In one embodiment, in accordance with the principles of the present disclosure, a zoned bed sheet is provided. The zoned bed sheet includes opposite first and second vertical sidewalls and opposite third and fourth vertical sidewalls that each extend between the first and second vertical sidewalls. A horizontal wall extends between the first and second vertical sidewalls and between the third and fourth vertical sidewalls. The horizontal wall is divided into a first side that includes the third vertical sidewall and a portion of each of the first and second vertical sidewalls and a second side that includes the fourth vertical sidewall and a portion of each of the first and second vertical sidewalls. The first and second sides each include a plurality of zones that can either be the same of different. The zones are spaced apart from one another by a first material. The zones each include a material that is different than the first material.

In one embodiment, in accordance with the principles of the present disclosure, a fitted bed sheet is provided. The fitted bed sheet includes opposite first and second vertical sidewalls and opposite third and fourth vertical sidewalls that each extends between the first and second vertical sidewalls. The third and fourth vertical sidewalls each include a first section comprising a first material and a second section comprising a second material that is different than the first material. A horizontal wall extends between the first and second vertical sidewalls and between the third and fourth vertical sidewalls. The horizontal wall is divided into a first side that includes the third vertical sidewall and a portion of each of the first and second vertical sidewalls and a second side that includes the fourth vertical sidewall and a portion of each of the first and second vertical sidewalls. The first side is configured to accommodate a first sleeper and the second side is configured to accommodate a second sleeper. The first and second sides each include a plurality of zones. The zones each include the second material. The zones are spaced apart from one another by the first material. The second material has a porosity that is greater than that of the first material. The second material is joined with the first material using seamless stitch binding. The zones each have the same thickness. The first material has the same thickness as the zones. The plurality of zones of the first side comprises a first zone, a second zone and a third zone. The first side is configured such that when the first sleeper lies on the first side, the first sleeper's head will rest upon the first zone, the first sleeper's waist will rest upon the second zone and the first sleeper's feet will rest upon the third zone. The plurality of zones of the second side comprise a fourth zone, a fifth zone and a sixth zone, the second side being configured such that when a second sleeper lays on the second side, the second sleeper's head will rest upon the fourth zone, the second sleeper's waist will rest upon the fifth zone and the second sleeper's feet will rest upon the sixth zone. Inner surfaces of the vertical sidewalls and the horizontal wall define a cavity configured for disposal of a mattress. In one embodiment, the bed sheet is configured such that air will enter the cavity through the zones and exit the cavity through the second sections.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
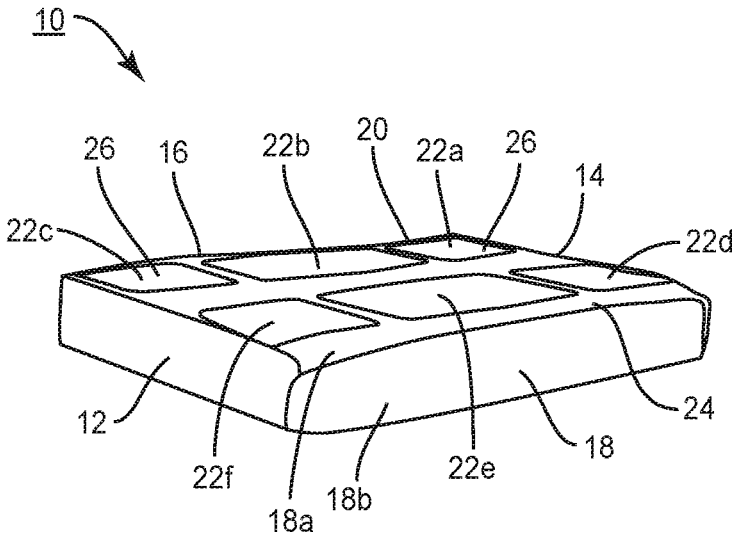
FIG. 1 is a perspective view of one embodiment of a zoned bed sheet in accordance with the principles of the present disclosure.
Figure 2:
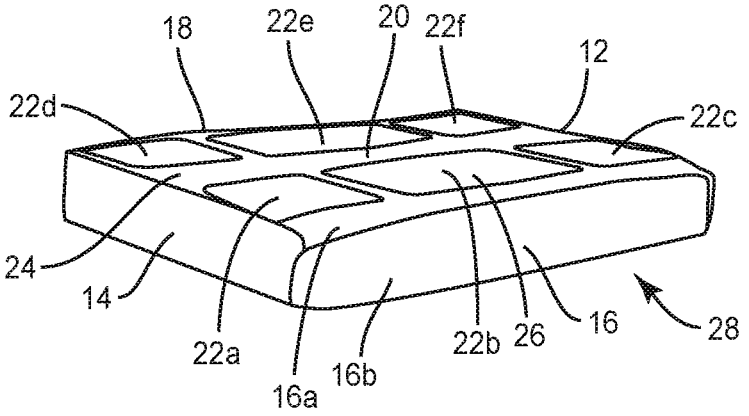
FIG. 2 is a perspective view of the zoned bed sheet shown in FIG. 1.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a zoned bed sheet in accordance with the principles of the present disclosure. Alternate embodiments are also disclosed. Reference will now be made in detail to the exemplary embodiments of the present disclosure, which are illustrated in the accompanying figures. Turning to FIGS. 1-4, there are illustrated components of a zoned bed sheet 10.

Zoned bed sheet 10 includes opposite first and second vertical sidewalls 12, 14. Zoned bed sheet 10 includes opposite third and fourth vertical sidewalls 16, 18 that each extend between first and second vertical sidewalls 12, 14. Vertical walls 12, 14, 16, 18 correspond to the vertical walls of a mattress when zoned bed sheet 10 is fitted over a mattress. In some embodiments, zoned bed sheet 10 is a fitted bed sheet that is pre-sewn to fit snugly over a mattress in a manner that allows zoned bed sheet 10 to remain on the mattress as one or more sleepers lay upon zoned bed sheet 10.

First and second vertical sidewalls 12, 14 extend parallel to one another. Third and fourth vertical sidewalls 16, 18 extend parallel to one another. Third and fourth vertical sidewalls 16, 18 extend transverse or perpendicular to first and second vertical sidewalls 12, 14. In some embodiments, first and second vertical sidewalls 12, 14 may be disposed at alternate orientations, relative to one another, such as, for example, transverse, perpendicular and/or other angular orientations such as acute or obtuse, co-axial and/or may be offset or staggered. In some embodiments, third and fourth vertical sidewalls 16, 18 may be disposed at alternate orientations, relative to one another, such as, for example, transverse, perpendicular and/or other angular orientations such as acute or obtuse, co-axial and/or may be offset or staggered. In some embodiments, first and second vertical sidewalls 12, 14 may be disposed at alternate orientations, relative to third and fourth vertical sidewalls 16, 18, such as, for example, transverse, perpendicular and/or other angular orientations such as acute or obtuse, co-axial and/or may be offset or staggered.

In some embodiments, third vertical sidewall 16 includes a first section 16*a* comprising a first material 24 and a second section 16*b* comprising a second material 26 that is different than first material 24 and fourth vertical sidewall 18 includes a first section 18*a* comprising first material 24 and a second section 18*b* comprising second material 26. To distinguish between first material 24 and second material 26 in the figures, first material 24 has darker shading than second material 26 does. In some embodiments, all or only a portion of portions 16*a*, 16*b*, 18*a*, 18*b* may be variously configured and dimensioned, such as, for example, planar, concave, polygonal, irregular, uniform, non-uniform, staggered, tapered, consistent or variable, depending on the requirements of a particular application. In some embodiments, portions 16*a*, 18*a* each have a surface area that is greater than the surface area of portions 16*b*, 18*b*. In some embodiments, portions 16*b*, 18*b* each have a surface area that is greater than the surface area of portions 16*a*, 18*a*.

In some embodiments, first material 24 comprises a circular knit. In some embodiments, first material 24 comprises polyester. In some embodiments, first material 24 comprises a circular knit constructed of 100% polyester. In some embodiments, first material 24 comprises a 100% polyester warp knit, polyester with a cotton blend or polyester with a wool blend. In some embodiments, second material 26 comprises a circular knit mesh. In some embodiments, second material 26 comprises polyester and spandex. In some embodiments, second material 26 comprises a circular knit constructed of 80-90% polyester and 10-20% spandex. In some embodiments, second material 26 comprises a circular knit constructed of 87% polyester and 13% spandex. In some embodiments, at least one of first material 24 and second material is free of at least one of the following materials: cotton, polyester, spandex, satin, wool, brushed polyester microfiber, silk, linen, bamboo, rayon, nylon, cellulose acetate, carbon fiber, aramid, fleece, flannel, denim, velvet, hemp, plastic, acrylic, rubber and paper. In some embodiments, at least one of first material 24 and second material includes at least one of the following materials: cotton, polyester, spandex, satin, wool, brushed polyester microfiber, silk, linen, bamboo, rayon, nylon, cellulose acetate, carbon fiber, aramid, fleece, flannel, denim, velvet, hemp, plastic, acrylic, rubber and paper.

Figure 3:
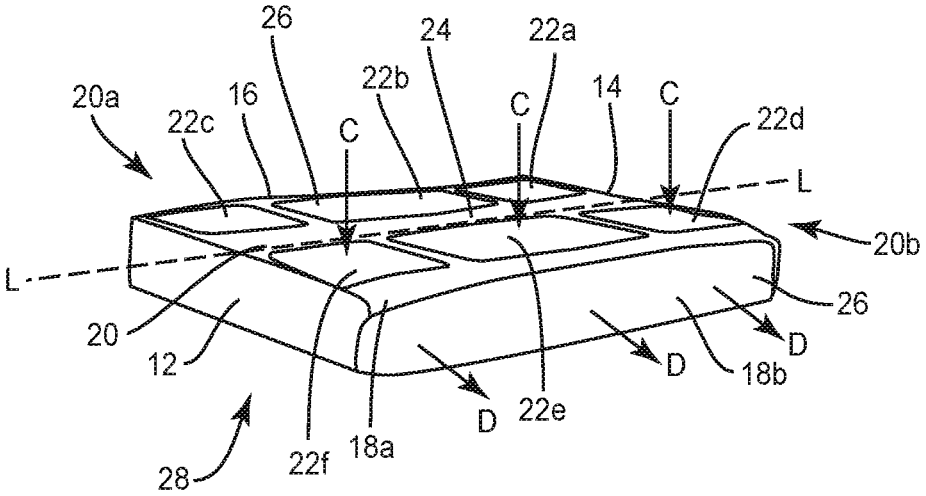
FIG. 3 is a perspective view of the zoned bed sheet shown in FIG. 1.
Figure 4:
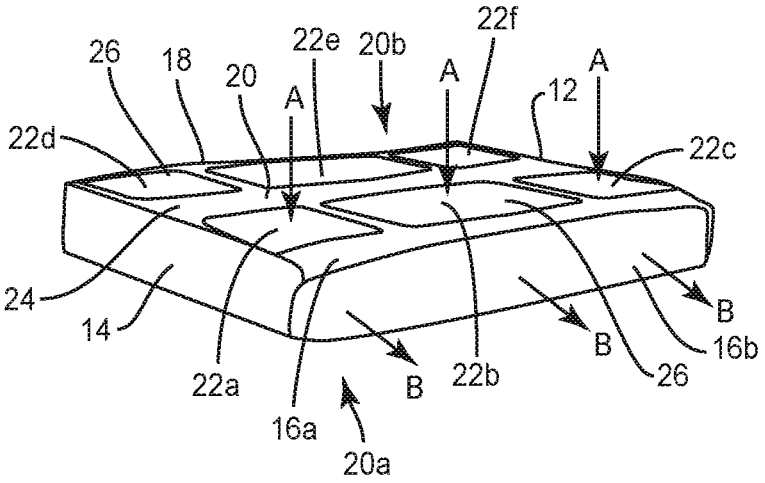
FIG. 4 is a perspective view of the zoned bed sheet shown in FIG. 1.

Zoned bed sheet 10 includes a horizontal wall 20 extending between first and second vertical sidewalls 12, 14 and between third and fourth vertical sidewalls 16, 18. Horizontal wall 20 is the portion of zoned bed sheet 10 that a sleeper rests upon. That is, an outer surface of horizontal wall 20 defines a sleep surface for one or more sleepers. In some embodiments, a line L divides horizontal wall 20 into a first side 20*a* that includes the third vertical sidewall 16 and a portion of each of first and second vertical sidewalls 12, 14 and a second side 20*b* that includes fourth vertical sidewall 18 and a portion of each of first and second vertical sidewalls 12, 14, as shown in FIGS. 3 and 4. First side 20*a* is configured to have a first sleeper rest thereupon and second side 20*b* is configured to have a second sleeper rest thereupon. That is, first side 20*a* is configured to accommodate the first sleeper and second side 20*b* is configured to accommodate the second sleeper. In some embodiments, first side 20*a* has a size or surface area that is equal or substantial equal to that of second side 20*b*.

First and second sides 20*a*, 20*b* each comprise one or a plurality of zones 22. Zones 22 each comprise second material 26. Zones 22 are spaced apart from one another by first material 24. As shown in FIGS. 1-4, side 20*a* of horizontal wall 20 includes zones 22*a*, 22*b*, 22*c* and side 20*b* of horizontal wall 20 includes zones 22*d*, 22*e*, and 22*f*. Zones 22 may be positioned on horizontal wall 20 using body-mapping such that zones 22 are located where a sleeper's body generates the most heat for enhanced airflow through zoned bed sheet 10 and/or a mattress that zoned bed sheet 10 is positioned over. Zones 22 are configured such that when a first sleeper lies upon first side 20*a* of horizontal wall 20, the first sleeper's head will rest upon zone 22*a*, the first sleeper's waist will rest upon zone 22*b* and the first sleeper's feet will rest upon zone 22*c*. Likewise, zones 22 are configured such that when a second sleeper lies upon second side 20*b* of horizontal wall 20, the second sleeper's head will rest upon zone 22*d*, the second sleeper's waist will rest upon zone 22*e* and the second sleeper's feet will rest upon zone 22*f*.

It is envisioned that zones 22 may be selectively positioned about horizontal wall 20. In some embodiments, zones are selectively positioned in areas where heat accumulates on the sleep surface of zoned bed sheet 10 such that heated air may exit the sleep surface through zones 22. That is, zones 22 may be selectively positioned in areas of horizontal wall 20 where the sleeper or sleepers desire greater air flow and be made from a material that is designed to channel heat away from the horizontal surface of the zone. For example, if the sleeper or sleepers find that heat tends to accumulate only at his or her feet or his or her head, zones 22 may be positioned where zones 22*c*, 22*f* are positioned in FIGS. 1-4 and zones 22*a*, 22*b*, 22*d*, 22*e* may be eliminated. As a further example, if the sleeper or sleepers find that heat tends to accumulate only at his or her feet or his or her head and at his or her middle portion, zones 22 may be positioned where zones 22*b*, 22*c*, 22*e*, 22*f* are positioned in FIGS. 1-4 and zones 22*a*, 22*d* may be eliminated. As a further example, if the sleeper or sleepers find that heat tends to accumulate only at his or her feet and at his or her head, zones 22 may be positioned where zones 22*a*, 22*c*, 22*d*, 22*f* are positioned in FIGS. 1-4 and zones 22*b*, 22*e* may be eliminated.

In some embodiments, second material 26 that zones 22 are formed from has a porosity that is greater than that of first material 24. In some embodiments, second material 26 has a porosity that is 10-50% greater than that of first material 24 so as to channel heat away from the sleeper. In some embodiments, second material 26 has a porosity that is 100-300% greater than that of first material 24 which allows a greater amount of heat to travel away from the sleeper leaving a cooler surface. In some embodiments, porosity is directly related to breathability such that the more porous the material is, the more breathable it is. In some embodiments, second material 26 is relatively non-porous and/or is a thermal reflective material so that heat remains/reflects towards the sleeper to keep the sleeper warmer in that zone as compared to a non-zoned sheet. In some embodiments, some zones made from a thermal reflective material are designed to retain heat in that zone and some zones are made from heat dissipating zones that are designed to channel heat away leaving that zone cooler than if heat was not channeled away. The zones can be positioned relative to each other so as to channel heat away from one zone and towards another zone where the sleeper desires to keep warm.

In some embodiments, second material 26 that zones 22 are made from is joined with first material 24 using stitching and/or binding, such as, for example, seamless stitch binding. In some embodiments, second material 26 that zones 22 are made from is joined with first material 24 using heat sealing to seamlessly join second material 26 with first material 24. In some embodiments, second material 26 that zones 22 are made from is sewn to first material 24 to join second material 26 with first material 24. In some embodiments, zones 22 each have the same thickness. In some embodiments, first material 24 has the same thickness as zones 22 and/or second material 26 so that the transition between materials is relatively seamless. In some embodiments, at least one of first material 24 and second material 26 are made from a single layer of fabric or other material. In some embodiments, at least one of first material 24 and second material 26 are made from multiple layers of fabric or other material. In some embodiments, one of first material 24 and second material 26 is made from multiple layers of fabric or other material and the other one of first material 24 and second material 26 is made from a single layer of fabric or other material. In some embodiments, first material 24 has a color that is different than that of second material 26. In some embodiments, first material 24 and second material 26 have identical wicking properties. In some embodiments, first material 24 and second material 26 have different wicking properties.

In some embodiments, zoned bed sheet 10 is one-piece seamless article and comprises a circular knit. In such embodiments, zoned bed sheet 10 is manufactured using a circular knitting machine, such as, for example, a seamless Santoni knitting machine. The circular knitting machine is configured to use yarns having different thicknesses or deniers. The circular knitting machine may be programmed to use yarns having a first thickness or denier to produce material 24 and yarns having a second thickness or denier to produce material 26, wherein the first thickness is different than the first thickness. In some embodiments, the first thickness is greater than the second thickness. In some embodiments, the first thickness is less than the second thickness. The circular knitting machine creates zoned bed sheet 10 row by row. Some rows will contain only material 24; some rows will contain only material 26; and some rows will contain material 24 and material 26. This allows zoned bed sheet 10 to be knitted as a tube, without any seams. That is, there are no seams between portions of zoned bed sheet 10 that are made from material 24 and portions of zoned bed sheet 10 that are made from material 26. The circular knitting machine will produce the same pattern for material 24 and material 26. However, where material 26 is made from yarns having a thickness or denier that less than the thickness or denier of the yarns used to make material 24, material 26 will be more porous than material 24 and/or have greater breathability than material 24. In some embodiments, material 26 is looser than material 24 such that material 26 is more porous and/or breathable than material 24.

In some embodiments, in addition to using different thickness of the yarns, the Santoni knitting machine, or its equivalent, can be programed to use different patterns in different regions of the zoned sheet while still producing a virtually seamless bedsheet 10. The different patterns can provide different textures, touch, porosities as well as other properties. Some patterns can provide greater breathability than other patterns in the sheet 10 while still being seamless. That is, the circular knitting machine will produce the same or different pattern for material 24 and material 26 giving material 24 and material 26 the same of different characteristics.

Inner surfaces of vertical sidewalls 12, 14, 16, 18 and horizontal wall 20 define a cavity 28 configured for disposal of a mattress and zoned bed sheet 10 is configured such that air will enter cavity 28 through zones 22 and exit cavity 28 through second sections 16*b*, 18*b* of third and fourth vertical sidewalls 16, 18. In particular, heated air may enter cavity 28 through at least one of zones 22*a*, 22*b*, 22*c* on first side 20*a* of horizontal wall 20 and exit cavity 28 through second section 16*b* of third vertical sidewall 16, as shown by arrows A and B in FIG. 4, thus drawing heated air away from the sleep surface to cool the sleep surface of horizontal wall 20 on first side 20*a* of horizontal wall 20. Likewise, heated air may enter cavity 28 through at least one of zones 22*d*, 22*e*, 22*f* on second side 20*b* of horizontal wall 20 and exit cavity 28 through second section 18*b* of fourth vertical sidewall 18, as shown by arrows C and D in FIG. 5, thus drawing heated air away from the sleep surface to cool the sleep surface of horizontal wall 20 on second side 20*b* of horizontal wall 20.

In some embodiments, at least one of first and second vertical sidewall 12, 14 includes a first section comprising first material 24 and a second section comprising second material 26. The first section of first and/or second vertical sidewall 12, 14 may be similar to first sections 16*a*, 18*a* of third and fourth vertical sidewalls 16, 18. Likewise, the second section of first and/or second vertical sidewall 12, 14 may be similar to second sections 16*b*, 18*b* of third and fourth vertical sidewalls 16, 18. In such embodiments, heated air will enter cavity 28 through zones 22 and exit cavity 28 through the second sections of at least one of first and second vertical sidewall 12, 14 and second sections 16*b*, and 18*b* of third and fourth vertical sidewalls 16, 18. For example, heated air may enter cavity 28 through at least one of zones 22*a*, 22*b*, 22*c* on first side 20*a* of horizontal wall 20 and exit cavity 28 through the second sections of at least one of first and second vertical sidewall 12, 14 and second section 16*b* of third vertical sidewall 16 thus drawing heated air away from the sleep surface to cool the sleep surface of horizontal wall 20 on first side 20*a* of horizontal wall 20. Heated air may also enter cavity 28 through at least one of zones 22*d*, 22*e*, 22*f* on second side 20*b* of horizontal wall 20 and exit cavity 28 through the second sections of at least one of first and second vertical sidewall 12, 14 and second section 18*b* of fourth vertical sidewall 18 thus drawing heated air away from the sleep surface to cool the sleep surface of horizontal wall 20 on second side 20*b* of horizontal wall 20.

Figure 5:
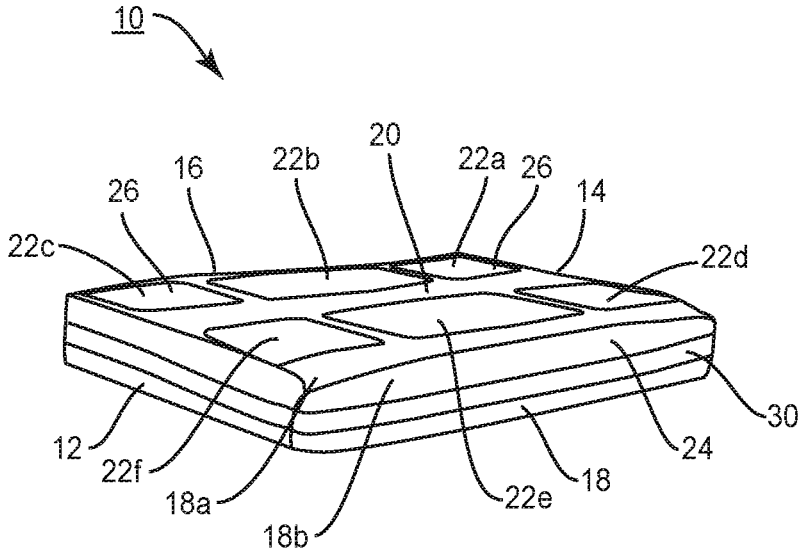
FIG. 5 is a perspective view of one embodiment of the zoned bed sheet shown in FIG. 1 in accordance with the principles of the present disclosure.
Figure 6:
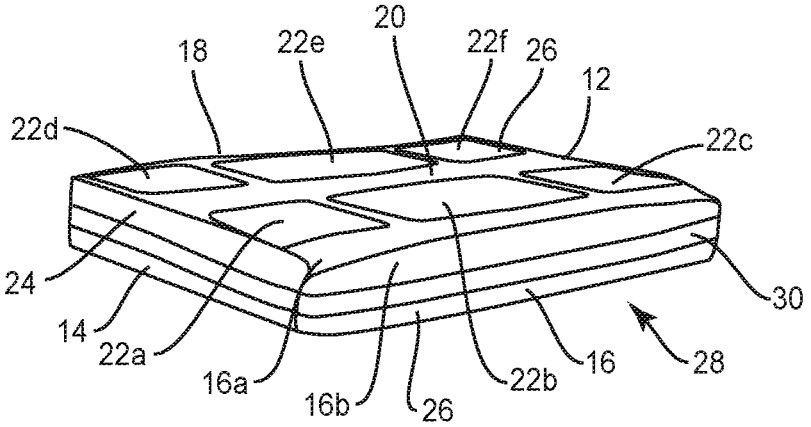
FIG. 6 is a perspective view of the zoned bed sheet shown in FIG. 5.

In one embodiment, shown in FIGS. 5 and 6, zoned bed sheet 10 comprises a core compression power band 30 that extends around the complete circumference of zoned bed sheet 10. Power band 30 extends across vertical sidewalls 12, 14, 16, 18, as shown in FIGS. 5 and 6. In some embodiments, power band 30 is attached to outer surfaces of vertical sidewalls 12, 14, 16, 18. In some embodiments, power band 30 is attached to inner surfaces of vertical sidewalls 12, 14, 16, 18. In some embodiments, power band 30 is embedded within vertical sidewalls 12, 14, 16, 18. Power band 30 comprises an elastic material. In some embodiments, the elastic material that power band 30 is made from is different than first material 24 and/or second material 26.

In one embodiment, the power band 30 is attached to zoned bed sheet 10 and is configured so as to be positioned beneath a mattress when the zoned sheet is on the mattress. This power band 30 configuration allows zoned bed sheet 10 to securely fit and grip the mattress, thus preventing zoned bed sheet 10 from being dislodged from the mattress or shifting on the mattress without expanding power band 30. That is, when zoned bed sheet 10 is positioned to cover a mattress, power band 30 must be stretched out to overcome the force of the powerful elastic material, thus allowing zoned bed sheet 10 to be removed from the mattress. It is envisioned that power band 30 may also assist with covering a mattress with zoned bed sheet 10 as the elastic material of power band 30 would pull itself tight below the mattress, such that a horizontal wall and vertical walls of the mattress are enclosed within zoned bed sheet 10, with the horizontal wall and the vertical walls of the mattress being positioned above power band 30.

In one embodiment zoned sheet 10 can have a second horizontal surface opposite the horizontal surface that defines a sleep surface, such as, for example, the surface a sleeper lays upon; and the vertical walls of the mattress are walls that connect the horizontal wall with an opposite second horizontal wall that defines a bottom surface of the mattress, the bottom surface being opposite the sleep surface. In this embodiment, at least a portion of the bottom horizontal surface contains the power band material.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bed sheet comprising:

opposite first and second vertical sidewalls;

opposite third and fourth vertical sidewalls each extending from the first vertical sidewall to the second vertical sidewall, outer surfaces of the first, second, third and fourth vertical sidewalls defining a circumference of the bed sheet;

a horizontal wall extending between the first and second vertical sidewalls and between the third and fourth vertical sidewalls, the first, second, third and fourth vertical sidewalls each including a first edge that directly engages the horizontal wall and an opposite second edge; and an elastic band positioned between the first edges and the second edges of at least one of the first, second, third and fourth vertical sidewalls, the elastic band extending around the circumference of the bed sheet.

2. The bed sheet recited in claim 1, wherein the horizontal wall comprises a plurality of zones.

3. The bed sheet recited in claim 2, wherein the zones are spaced apart from one another by a first material, at least one of the zones comprising a second material that is different than the first material.

4. The bed sheet recited in claim 3, wherein the first material comprises a warp knit.

5. The bed sheet recited in claim 3, wherein the second material is more porous than the first material.

6. The bed sheet recited in claim 3, wherein the zones each comprise the second material such that the zones each have the same thickness, the first material having the same thickness as the zones.

7. The bed sheet recited in claim 2, wherein the elastic band is spaced apart from the first edges.

8. The bed sheet recited in claim 2, wherein the zones include a first zone, a second zone and a third zone positioned between the first zone and the second zone, the third zone being spaced apart from the first zone and the second zone.

9. The bed sheet recited in claim 2, wherein the zones include a first column comprising a first zone, a second zone and a third zone positioned between the first zone and the second zone, the third zone being spaced apart from the first zone and the second zone, the zones including a second column comprising a fourth zone, a fifth zone and a sixth zone positioned between the fourth zone and the fifth zone, the sixth zone being spaced apart from the fourth zone and the fifth zone.

10. The bed sheet recited in claim 1, wherein the elastic band is spaced apart from the first edges and the second edges.

11. A bed sheet comprising:

opposite first and second vertical sidewalls;

opposite third and fourth vertical sidewalls each extending from the first vertical sidewall to the second vertical sidewall, outer surfaces of the first, second, third and fourth vertical sidewalls defining a circumference of the bed sheet;

a horizontal wall extending between the first and second vertical sidewalls and between the third and fourth vertical sidewalls, the first, second, third and fourth vertical sidewalls each including a first edge that directly engages the horizontal wall and an opposite second edge; and an elastic band extending around the circumference of the bed sheet such that the elastic band is spaced apart from the first edges and the second edges.

12. The bed sheet recited in claim 11, wherein the horizontal wall comprises a plurality of zones, the zones being spaced apart from one another by a first material, at least one of the zones comprising a second material that is different than the first material.

13. The bed sheet recited in claim 11, wherein the horizontal wall comprises a plurality of zones, the zones including a first column comprising a first zone, a second zone and a third zone positioned between the first zone and the second zone, the third zone being spaced apart from the first zone and the second zone, the zones including a second column comprising a fourth zone, a fifth zone and a sixth zone positioned between the fourth zone and the fifth zone, the sixth zone being spaced apart from the fourth zone and the fifth zone.

14. A bed sheet comprising:

opposite first and second vertical sidewalls;

opposite third and fourth vertical sidewalls each extending from the first vertical sidewall to the second vertical sidewall;

a horizontal wall extending between the first and second vertical sidewalls and between the third and fourth vertical sidewalls, the first, second, third and fourth vertical sidewalls each including a first edge that directly engages the horizontal wall and an opposite second edge; and an elastic band positioned between the first edges and the second edges of at least one of the first, second, third and fourth vertical sidewalls, wherein the horizontal wall comprises a plurality of zones, the zones including a first column comprising a first zone, a second zone and a third zone positioned between the first zone and the second zone, the third zone being spaced apart from the first zone and the second zone, the zones including a second column comprising a fourth zone, a fifth zone and a sixth zone positioned between the fourth zone and the fifth zone, the sixth zone being spaced apart from the fourth zone and the fifth zone.

15. The bed sheet recited in claim 14, wherein the elastic band is spaced apart from the first edges.

16. The bed sheet recited in claim 14, wherein the elastic band is spaced apart from the second edges.

17. The bed sheet recited in claim 14, wherein the elastic band is spaced apart from the first edges and the second edges.

18. The bed sheet recited in claim 14, wherein the zones are spaced apart from one another by a first material, at least one of the zones comprising a second material that is different than the first material.

19. The bed sheet recited in claim 18, wherein the second material is more porous than the first material.

* * * * *